US006971537B2

(12) United States Patent
Enright, Jr.

(10) Patent No.: US 6,971,537 B2
(45) Date of Patent: Dec. 6, 2005

(54) SUPPORT ARRANGEMENT FOR SEMI-MEMBRANE TANK WALLS

(75) Inventor: Marc E. Enright, Jr., Groton, CT (US)

(73) Assignee: Electric Boat Corporation, Groton, CT (US)

( * ) Notice: Subject to any disclaimer, the term of this patent is extended or adjusted under 35 U.S.C. 154(b) by 0 days.

(21) Appl. No.: 09/972,565

(22) Filed: Oct. 5, 2001

(65) Prior Publication Data

US 2003/0066834 A1 Apr. 10, 2003

(51) Int. Cl.[7] ..... F17C 13/08
(52) U.S. Cl. ..... 220/560.08; 220/560.11
(58) Field of Search ..... 220/646, 560.08, 220/560.05, 560.06, 901, 668, 9.4, 560.04, 220/56.07, 560.11; 248/569, 583, 602

(56) References Cited

U.S. PATENT DOCUMENTS 3,071,094 A * 1/1963 Leroux ..... 114/74 A
3,319,431 A * 5/1967 Clarke et al. ..... 62/53.2
3,425,583 A * 2/1969 Bridges ..... 220/560.05
3,839,981 A * 10/1974 Giles ..... 114/74 A
3,853,240 A * 12/1974 Alleaume ..... 220/560.09
3,908,574 A * 9/1975 Miller et al. ..... 114/74 R
3,937,353 A * 2/1976 Becker et al. ..... 220/560.12
4,013,030 A 3/1977 Stafford
4,156,492 A * 5/1979 Cavanna et al. ..... 220/560.1
5,727,492 A 3/1998 Cuneo et al.
6,626,319 B2 * 9/2003 Miller et al. ..... 220/560.07

* cited by examiner

*Primary Examiner*—Joseph C. Merek
(74) *Attorney, Agent, or Firm*—Michael J. Bell; Howrey LLP

(57) ABSTRACT

In the support arrangements for a semi-membrane tank walls described in the specification, the top and side walls of a semi-membrane tank are provided with stiffener members and a surrounding tank support structure has support members which are connected to the stiffener members through support assemblies which provide vertical support for the tank walls while permitting relative motion in the horizontal direction. Each support assembly includes a bracket affixed to one of the support members and a spool affixed to a wall stiffener along with a thermally insulating block having an end portion slidably received in the bracket and having an internal groove extending in a direction orthogonal to the sliding motion of the end portion. The enlarged head of the spool affixed to the stiffener is received in the groove, thereby permitting relative motion of the tank wall with respect to the support structure and two orthogonal directions while providing load support for the tank wall in the vertical direction.

3 Claims, 4 Drawing Sheets

SUPPORT ARRANGEMENT FOR SEMI-MEMBRANE TANK WALLS

BACKGROUND OF THE INVENTION

This invention relates to arrangements for supporting the walls of semi-membrane tanks which are subject to thermal expansion and contraction.

Tanks for holding liquefied gases such as liquefied natural gas ("LNG") may have a semi-membrane construction of the type described in U.S. Pat. No. 5,727,492 in which the tank walls are not sufficiently rigid to be self supporting and require a surrounding support structure which may consist of a grid of beams or the like connected to the membrane walls of the tank through insulating blocks. Because the temperature of the tank walls may vary between low temperature when the tank contains a liquefied gas and ambient temperature whereas the supporting structure is normally at the ambient temperature the tank walls may be subject to stresses resulting from thermal expansion and contraction with respect to the supporting structure.

The Stafford U.S. Pat. No. 4,013,030 shows a support arrangement for a spherical LNG tank consisting of a circular array of support units each being joined at the top to the tank and at the bottom to a circular base and having a vertical key with radial contact faces located between and in slidable contact with a pair of opposing vertical faces of a keyway containing a load-bearing insulation block. Each support unit also has a vertical coupling consisting of a sleeve and a cylindrical element within the sleeve which are relatively rotatable about a vertical axis. The tank is thus free to expand horizontally with temperature changes because of the sliding motion of the block in the keyway and the sliding action is maintained precisely radial to the tank's center because of the angular positioning of the components through the sleeve and the cylindrical element. A spherical LNG tank, however, is self supporting and does not present the problem of relative motion between a wall of a semi-membrane tank and an adjacent supporting structure.

SUMMARY OF THE INVENTION

Accordingly, it is an object of the present invention to provide a support arrangement for semi-membrane tank walls which overcomes disadvantages of the prior art.

Another object of the present invention is to provide a support arrangement for semi-membrane tank walls which permits relative motion of the tank walls with respect to the support structure while providing thermal insulation between those components.

These and other objects of the invention are attained by providing a support structure having a plurality of support members disposed adjacent to the walls of a semi-membrane tank and a plurality of support assemblies connecting the tank walls to the members support structure and permitting relative sliding motion between them. In a preferred embodiment each support assembly includes a first support component affixed to a support member, a second support component affixed to a tank wall, and a support structure permitting relative sliding motion between the first and second components in two orthogonal directions while providing vertical load-bearing support for the wall. Preferably the support structure includes a load-bearing insulating support block having a T-shaped vertical configuration with an end part which is slidably supported in the first support component and an internal groove slidably receiving a part of the second support component, the groove being oriented orthogonally with respect to the sliding direction of the support block with respect to the first support component. In a preferred arrangement each of the supported tank walls is provided with stiffeners to which the second support components are affixed.

BRIEF DESCRIPTION OF THE DRAWINGS

Further objects and advantages of the invention will be apparent from a reading of the following description in conjunction with the accompanying drawings in which.

DESCRIPTION OF PREFERRED EMBODIMENTS

Figure 1:
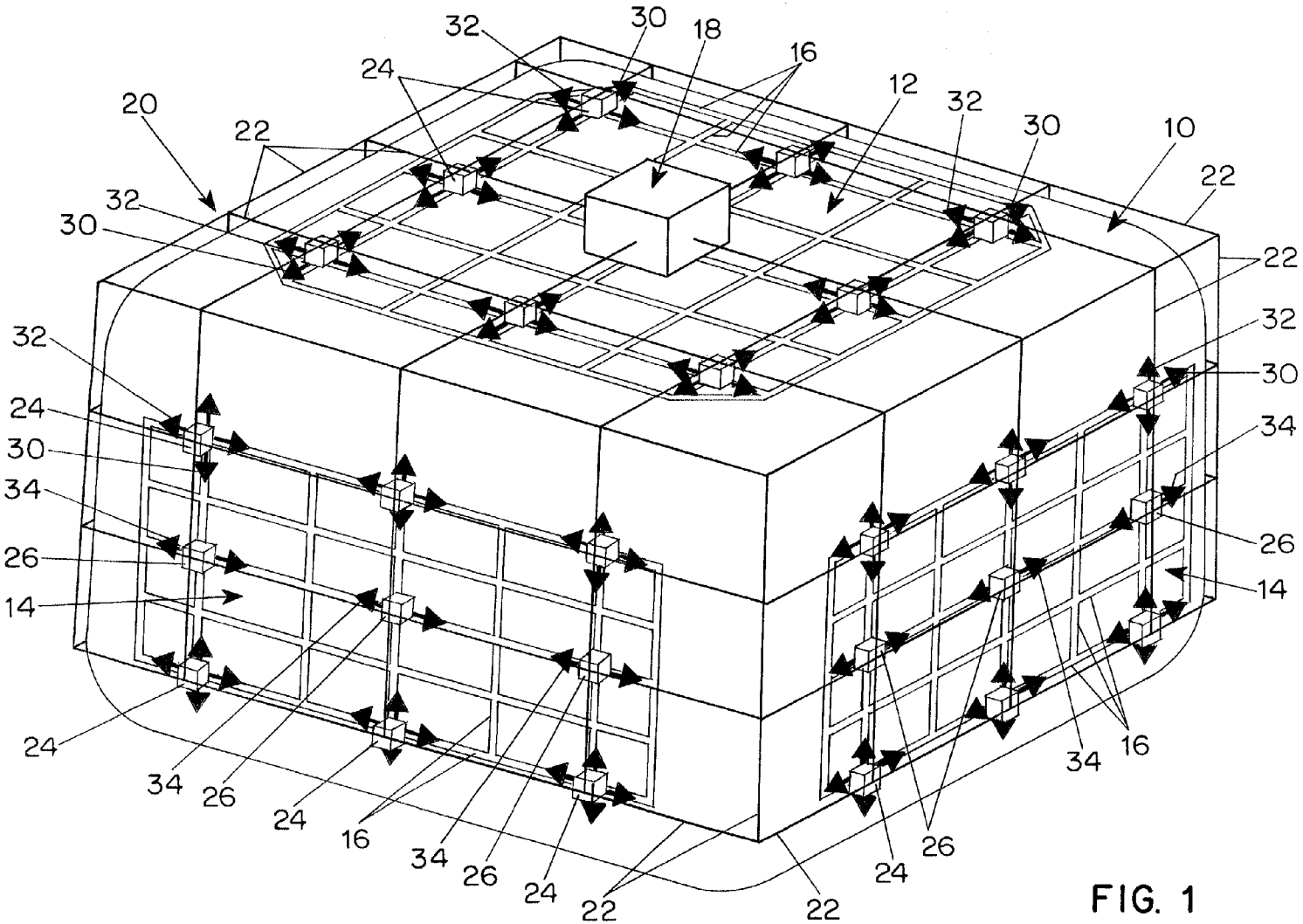
FIG. 1 is a perspective view schematically illustrating a representative embodiment of a tank having semi-membrane walls supported by a support arrangement in accordance with the invention.

In the representative embodiment of the invention schematically illustrated in FIG. 1, a semi-membrane tank 10 has a top wall 12 and four sidewalls 14, each wall having an array of stiffeners 16 affixed to its outer surface. A pipe tower 18 extends above the top wall 12 at the center of the tank to facilitate filling and emptying of the tank.

Each of the sidewalls 14 and the top wall 12 are supported from a schematically illustrated support carriage 20 consists of a grid of intersecting beams 22 which surrounds the top and sidewalls of the tank. The support carriage 20 may be of the type described in copending application Ser. No. 09/873,508, filed Jun. 4, 2001, the disclosure of which is incorporated by reference herein. The beams 22 are connected to the tank wall stiffeners 16 by a plurality of support assemblies 24 and 26 which provide load support in the vertical direction and permit relative sliding motion in the horizontal direction between the carriage 20 and the adjacent wall 12 or 14 Each support assembly 24 is arranged in the manner described hereinafter to permit relative sliding motion in two orthogonal directions, represented by the arrows 30 and 32 in FIG. 1, to accommodate thermal expansion and contraction of the tank walls with respect to the adjacent beam 22 in carriage 20.

The support assemblies 26 connect the side walls 14 to the beams 22 of the carriage 20 along a horizontal plane in the vertically central region of the sidewalls. Those support assemblies permit relative motion between the walls and the carriage beams only in the horizontal direction, as indicated by the arrows 34 in FIG. 1, thereby accommodating relative horizontal motion due to thermal expansion and contraction while providing load support for the sidewalls in the vertical direction.

Figure 2:
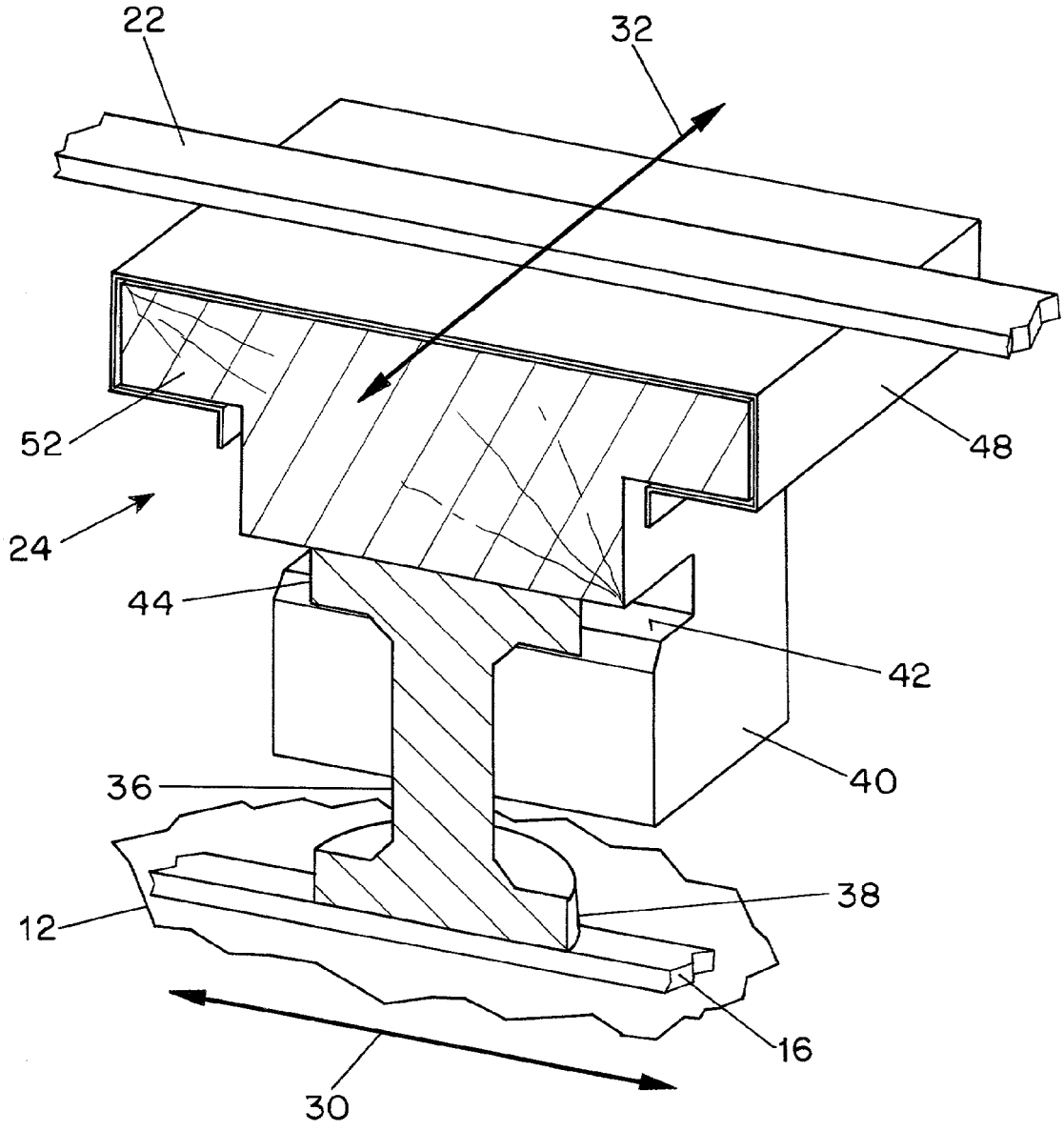
FIG. 2 is a perspective cutaway view showing a representative embodiment of a support assembly used in the support arrangement shown in FIG. 1.
Figure 3:
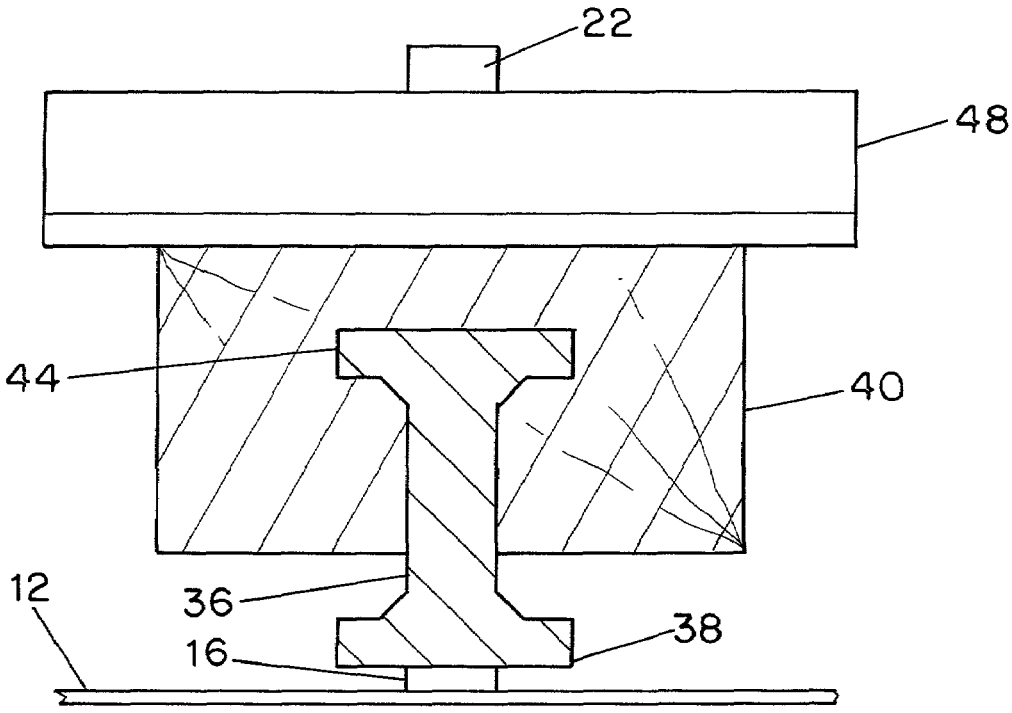
FIG. 3 is a side view showing the components of the support assembly illustrated in the cutaway view shown in FIG. 2.
Figure 4:
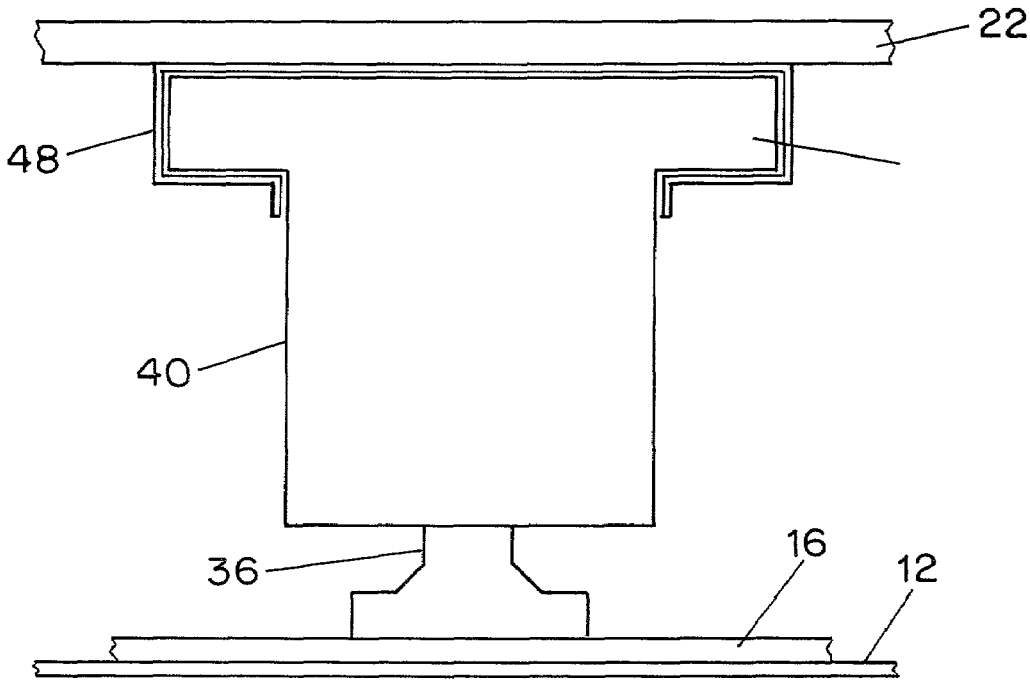
FIG. 4 is an end view of the support assembly shown in FIG. 2.

A representative embodiment of a support assembly 24 is illustrated in FIGS. 2–4. As best seen in FIG. 2, a support assembly 24 includes a first component in the form of a spool 36 which is affixed at its base 38 to one of the stiffeners 16 on the tank wall to be supported, a guide block 40 having a groove 42 which receives an enlarged head 44 of the spool to permit relative motion between the spool and the guide block in the longitudinal direction of the groove, represented by the arrow 30 and a second member in the form of a bracket 48 which is affixed to an adjacent beam 22 of the carriage 20. The guide block 40 has an enlarged flange 52 that is slidably received in the bracket 48 to permit relative motion between the guide block 40 and the carriage member 22 in the direction orthogonal to the arrow 30 as indicated by the arrow 32.

Preferably the spool 36 is made from an aluminum alloy suitable for cryogenic applications such as Alloy 5083 but it also may be made from austenitic stainless steel, which has a lower thermal conductivity than aluminum. If thermal loss through the support assembly is to be minimized, the spool 36 may be made by welding discs to opposite ends of bar stock but, to reduce stress concentrations and improve fatigue life while insuring perpendicularity between the spindle and the enlarged ends, it is preferable to make the spool 36 by machining a single piece of bar stock on a lathe.

In order to provide thermal insulation between the walls 12 and 14 of the tank 10 and the beams 22 of the support carriage 20, the guide block 40 is preferably constructed from a wood laminate capable of providing a high load-bearing capacity as well as thermal insulation between the tank wall and the support carriage. One suitable material for the block is a resin-impregnated compressed beechwood laminate marketed under the name "Lignostone" by Röchling Composites.

The support assemblies 26 which permit relative motion in only one horizontal direction and provide vertical load support in the orthogonal direction, are similar to the support assemblies 24 except that one of the first and second components thereof, preferably the spool 36 together with the corresponding groove 42, is omitted so that the guide block 40 is affixed directly to the stiffener 16 with the bracket 48 oriented to permit relative motion in the horizontal direction.

Figure 5:
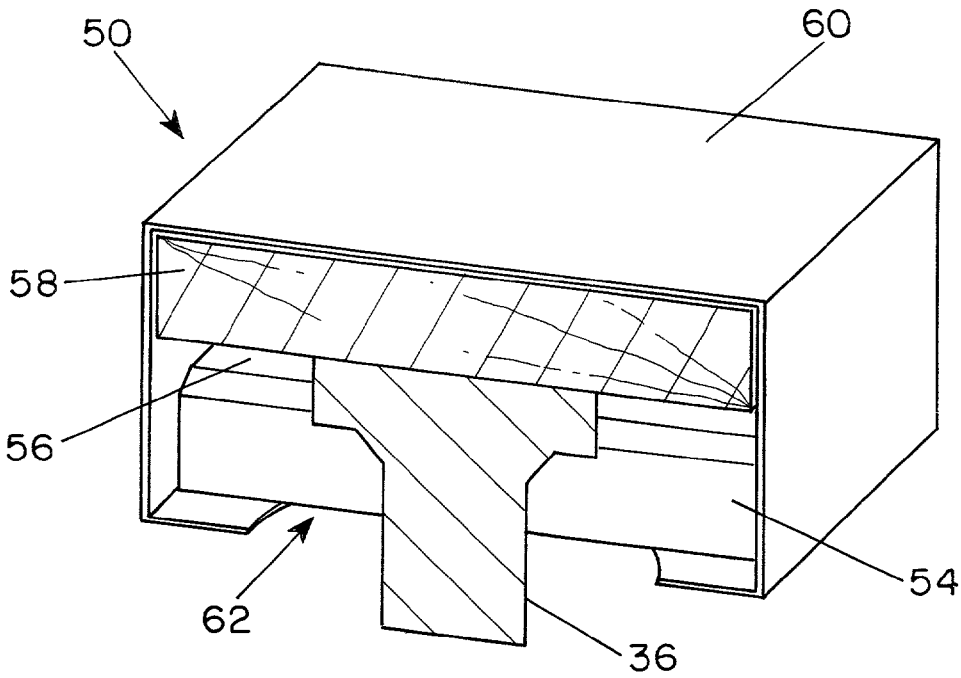
FIG. 5 is a perspective cutaway view illustrating another embodiment of a support assembly for use in the support arrangement shown in FIG. 1.
Figure 6:
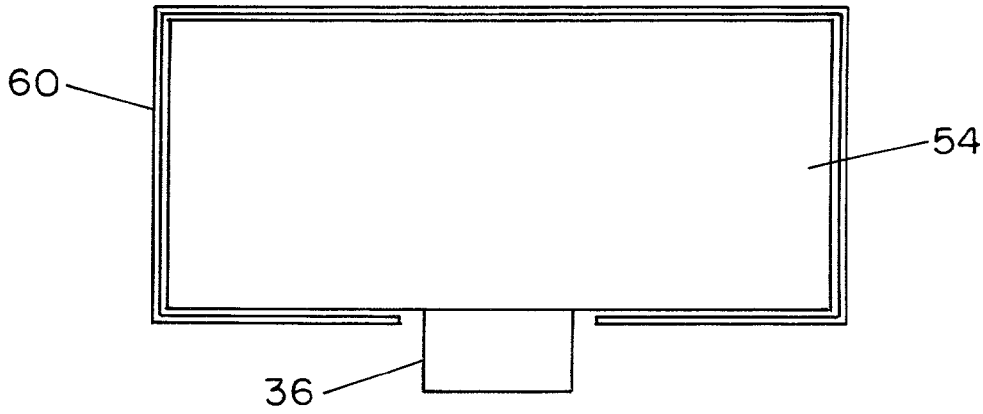
FIG. 6 is an end view of the support assembly shown in FIG. 5.

In an alternative embodiment, a support assembly 50, illustrated in part in FIGS. 5 and 6, includes a support spool 52 and a guide block 54, which has a groove 56 to receive the end of the spool 52 and an enlarged end 58 received in a bracket 60 which extends down the sides and along the bottom of the guide block 54, substantially enclosing the guide block but leaving a slot 62 in the bottom wall to accommodate relative motion of the spool 52 in the direction of the groove 56. In this configuration the tensile capacity of the support assembly is not limited by the bending strength of the guide block 54 at the root of the groove 56 which receives the spool disc. Moreover, the sleeve covers the ends of the groove 56, preventing the spool from passing out of the groove.

Although the invention has been described herein with respect to specific embodiments many modifications and variations therein will readily occur to those skilled in the art. Accordingly, all such variations and modifications are included within the intended scope of the invention.

I claim:

1. A support arrangement for a semi-membrane tank comprising:

an array of support members disposed adjacent to the semi-membrane tank, the semi-membrane tank having at least one substantially horizontal wall and one substantially vertical wall;

a first plurality of support assemblies connecting the array of support members to the at least one horizontal wall and providing support for the horizontal wall in a substantially vertical direction while permitting relative sliding motion therebetween in at least one substantially horizontal direction, each of the first plurality of support assemblies comprising:

a first component affixed to the horizontal wall;

a second component member affixed to the array of support members; and a support structure connecting the first and second components and permitting relative sliding motion between the first and second components in a substantially horizontal direction while providing vertical load support for the horizontal wall;

a second plurality of support assemblies connecting the support members to the at least one vertical wall and permitting relative sliding motion therebetween in at least one substantially horizontal direction, each of the second plurality of support assemblies comprising:

a first component affixed to the vertical wall;

a second component member affixed to the array of support members; and a support structure connecting the first and second components and permitting relative sliding motion between the first and second components in a substantially horizontal direction; and wherein the second plurality of support assemblies permits relative sliding motion between the array of support members and the vertical wall in a substantially horizontal direction and a substantially vertical direction.

2. The support arrangement according to claim 1, wherein the second plurality of support assemblies are substantially located above and below a horizontal center line of the vertical wall.

3. The support arrangement according to claim 1, wherein a third plurality of support assemblies connecting the array of support members to the at least one vertical wall are substantially located along a horizontal center line of the vertical wall.

* * * * *